US006808249B1

(12) United States Patent
Kneezel et al.

(10) Patent No.: US 6,808,249 B1
(45) Date of Patent: Oct. 26, 2004

(54) REDUCED NUMBER OF NONBUTTABLE FULL-WIDTH ARRAY PRINTBARS REQUIRED IN A COLOR PRINTER

(75) Inventors: Gary A. Kneezel, Webster, NY (US); Yoshihiko Fujimujra, Fujisawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/735,677

(22) Filed: Dec. 16, 2003

(51) Int. Cl.[7] ..... B41J 2/21; B41J 2/155
(52) U.S. Cl. ..... 347/43; 347/42
(58) Field of Search ..... 347/42, 40, 43

(56) References Cited

U.S. PATENT DOCUMENTS

| | | | | |
|---|---|---|---|---|
| 4,999,077 A | | 3/1991 | Drake et al. | 156/299 |
| 5,160,945 A | | 11/1992 | Drake | 347/42 |
| 5,192,959 A | | 3/1993 | Drake et al. | 347/42 |
| 5,198,054 A | | 3/1993 | Drake et al. | 156/64 |
| 5,218,754 A | | 6/1993 | Rangappan | 29/611 |
| 5,270,738 A | | 12/1993 | Takahashi et al. | 347/24 |
| 5,280,308 A | | 1/1994 | Takahashi et al. | 346/134 |
| 5,343,227 A | | 8/1994 | Hirosawa et al. | 347/42 |
| 5,587,730 A | * | 12/1996 | Karz | 347/43 |
| 5,710,582 A | | 1/1998 | Hawkins et al. | 347/42 |
| 6,027,203 A | * | 2/2000 | Campbell | 347/42 |

* cited by examiner

*Primary Examiner*—Thinh Nguyen
(74) *Attorney, Agent, or Firm*—Oliff & Berridge, PLC

(57) ABSTRACT

A nonbuttable full-width array printhead with reduced number of printbars required in a color printer is disclosed. The number of printbars may be reduced by including one single color printbar for each color and an additional printbar with multicolor die modules including each of the colors of the single color printbars. Die modules on each of the single color printbars are spaced closer together but are not butted. The total number of printbars may also be reduced by staggering printbars with multicolor die modules between printbars with the single color die modules. In the latter case, it is possible to preserve the order that inks of the various colors are applied for all regions of the printed paper.

20 Claims, 4 Drawing Sheets

REDUCED NUMBER OF NONBUTTABLE FULL-WIDTH ARRAY PRINTBARS REQUIRED IN A COLOR PRINTER

BACKGROUND OF THE INVENTION

1. Field of Invention

This invention relates to an ink jet printer, and particularly to nonbuttable full-width array printbars, and more particularly to reducing the number of nonbuttable full-width array printbars required in a color printer by including one printbar with multicolor die modules or by staggering printbars with multicolor die modules between printbars with single color die modules.

2. Description of Related Art

In an ink jet printing apparatus, individual drops of ink are ejected from a nozzle such that the droplet of ink travels under its own momentum towards a sheet of paper or other print medium on which drops of ink are intended to fall, with the impact areas overlapping so that they form characters or other marks of desired shape. In the ink jet printing apparatus, a printhead including a printbar with several die modules may be used with a plurality of individual nozzles in which to dispel the ink droplets. Such printheads are scanned across the medium to be marked in order to print the entire page.

Alternatively, with a page-width printhead, the printhead is stationary and dispels ink onto the medium from the top of the medium to the bottom. With a page-width printhead, the printhead will include a full-width printbar with several die modules accurately positioned with respect to each other so that the line of picture elements (pixels) produced by printed droplets from neighboring modules show no seams, and the pixels appear to be produced by one continuous line of uniformly spaced ink drop nozzles. An ink may be deposited onto the print medium one line at a time by the full-width printbar as the paper passes by until full-page images are completed. This type of ink jet printing process uses a single pass method and is known as a "full-width array" printer.

Various methods are known for fabricating full-width array printbars. One method is to form a linear pagewidth printbar by providing end-to-end abutment of fully functional printhead elements (die modules) on a substrate. This type of arrangement is termed buttable or butted. In other words, each of the die modules are positioned joined end to end with respect to each other such that the die modules together make up the print region of the print medium. The die modules are positioned end to end so that the pixels produced by neighboring modules show no seams, and the pixels appear to be produced by one continuous line of uniformly spaced ink drop nozzles. U.S. Pat. Nos. 5,192,959, 4,999,077, and 5,198,054 disclose processes for forming linear printbars of butted subunits.

Because each of the die modules are positioned joined end to end with respect to each other on a single substrate such that the die modules together make up the print region of the print medium, only one full width printbar is necessary, for example, with a black ink only system. Additional full-width color printbars may be added to enable a highlight or full color printer.

In a multi-color ink jet printing process, several full-width array printbars are used in a printer to deposit different color inks onto a print medium to give full color images. The different color inks comprise, for example, black, cyan, magenta, and yellow inks.

U.S. Pat. Nos. 5,280,308, 5,343,227, and 5,270,738 disclose full color pagewidth printers with four printbars, black, cyan, magenta, and yellow.

However, in a full-width array printbar with die modules abutted end to end, the joints between successive die modules make it difficult to accurately and precisely print on a print medium.

Another method for fabricating a full-width printbar is to provide same color die modules as two separated printbars. This type of arrangement is referred to as nonbuttable as the die modules of the printbars are not abutting each other. Die modules of the first printbar are spaced substantially evenly apart, creating a gap between each of the die modules. Die modules of the same output color are then located on the second printbar in a spaced apart manner such that they align with the gaps between the die modules on the first printbar. The die modules of the two printbars thus overlap so that the die modules of the two printbars together make up the print region of the print medium. In other words, the die modules of the two printbars are staggered to form a checker board pattern, but also overlap each other. For this arrangement, two printbars are required for each color to be printed. Thus, for a four-color printer, for example, eight printbars are required.

FIG. 1 shows such a typical printhead configuration 10 for a four-color nonbuttable full-width array printer. Two printbars (i.e., two halfbars 12) for each of the four colors, cyan (C), magenta (M), yellow (Y) and black (K) for a total of eight halfbars 12 are illustrated. In FIG. 1, six die modules 22 are provided on each halfbar, and twelve die modules 22 are provided for each color. The printing length of each die module is L. Because there is some overlap of die modules 22 from each complementary halfbar for each color, the overall printing length P is a little less than the length of all twelve die modules.

More specifically, the total allowable printing length P (preferably the width of the paper being printed) is printed using the two complementary staggered halfbars 12 for each color. Each of the plurality of die modules 22 on each halfbar 12 has a printing length L. The spacing between each of the plurality of die modules 22 also has a length of L, or more typically a little less than L, in order to allow some overlap between the die modules 22 of the two complementary staggered halfbars 12. Thus, a stitch between the die modules 22 is less obvious by printing half pixels near the stitch from one of the die modules 22 and the other half of the pixels by the complementary die module 22 on the other halfbar 12. Usually the gap between printing sections of adjacent modules on the same halfbar 12 is not completely empty. Typically, one of the die modules 22 extends beyond the last printing nozzle on each end of the printbar, and typically the ends of an ink manifold (not shown) extend beyond the ends of each of the die modules 22.

A consideration when designing a pagewidth color printer is the cost and maintenance of the full width printbars. Thus, reducing the number of required printbars would reduce cost as well as result in a more compact printer.

SUMMARY OF THE INVENTION

There is a need for a reduction in the number of nonbuttable full-width array printbars required in a printhead of a color printer.

There is also a need to simplify the ink delivery system of color printers with nonbuttable full-width array printbars.

There is further a need to increase the speed of color printers without detracting from the color integrity or uniformity of the image printed.

There is also a need for a color printer with nonbuttable full-width array printbars with enhanced colors for printed color images and having a fuller range of colors.

There is further a need for a color printer with nonbuttable full-width array printbars with fewer parts for an overall more compact structure.

There is a need to simplify maintenance of a color printer with nonbuttable full-width array printbars.

There is a need to reduce costs associated with maintenance of a color printer with nonbuttable full-width array printbars.

The above and other advantages are achieved by various embodiments of the invention.

In exemplary embodiments, fewer parts are required for a more compact printer structure.

In exemplary embodiments, the configuration of the printbars may provide enhanced color images.

In exemplary embodiments, problems associated with the ink delivery system of nonbuttable full-width array printbars may be improved.

In exemplary embodiments, the configuration of the printbars may provide greater uniformity of colors with fewer parts.

In exemplary embodiments, the configuration of the printbars may provide greater integrity of colors with fewer parts.

BRIEF DESCRIPTION OF THE DRAWINGS

The invention will be described with reference to the following drawings, wherein:

Referring to FIG. 2, an embodiment of the invention is illustrated with a reduction in the number of typical required printbars. One primary printbar for each color is illustrated (i.e., a primary printbar for yellow 30, a primary printbar for magenta 32, a primary printbar for cyan 34 and a primary printbar for black 36). Each primary printbar is comprised of the die modules 22 on a top surface 24 of a substrate 26. A printbar may alternatively be mounted on a bottom surface 25 of the substrate 26. The die modules 22 on the top surface 24 of the substrate 26 for each of the primary printbars 30, 32, 34 and 36, illustrated in FIG. 2, are more tightly packed than the die modules 22 on the halfbars of FIG. 1. That is, the spacing (gaps 28) between each of the die modules 22 is reduced as compared to the configuration of FIG. 1. For example, each of the gaps 28 of the die modules 22 illustrated in FIG. 1 have a length substantially equal to or less than the length L of each of the die modules. Whereas the gaps 28 illustrated in FIG. 2, as discussed in detail below, have a length substantially equal to one quarter of the length L.

Figure 2:
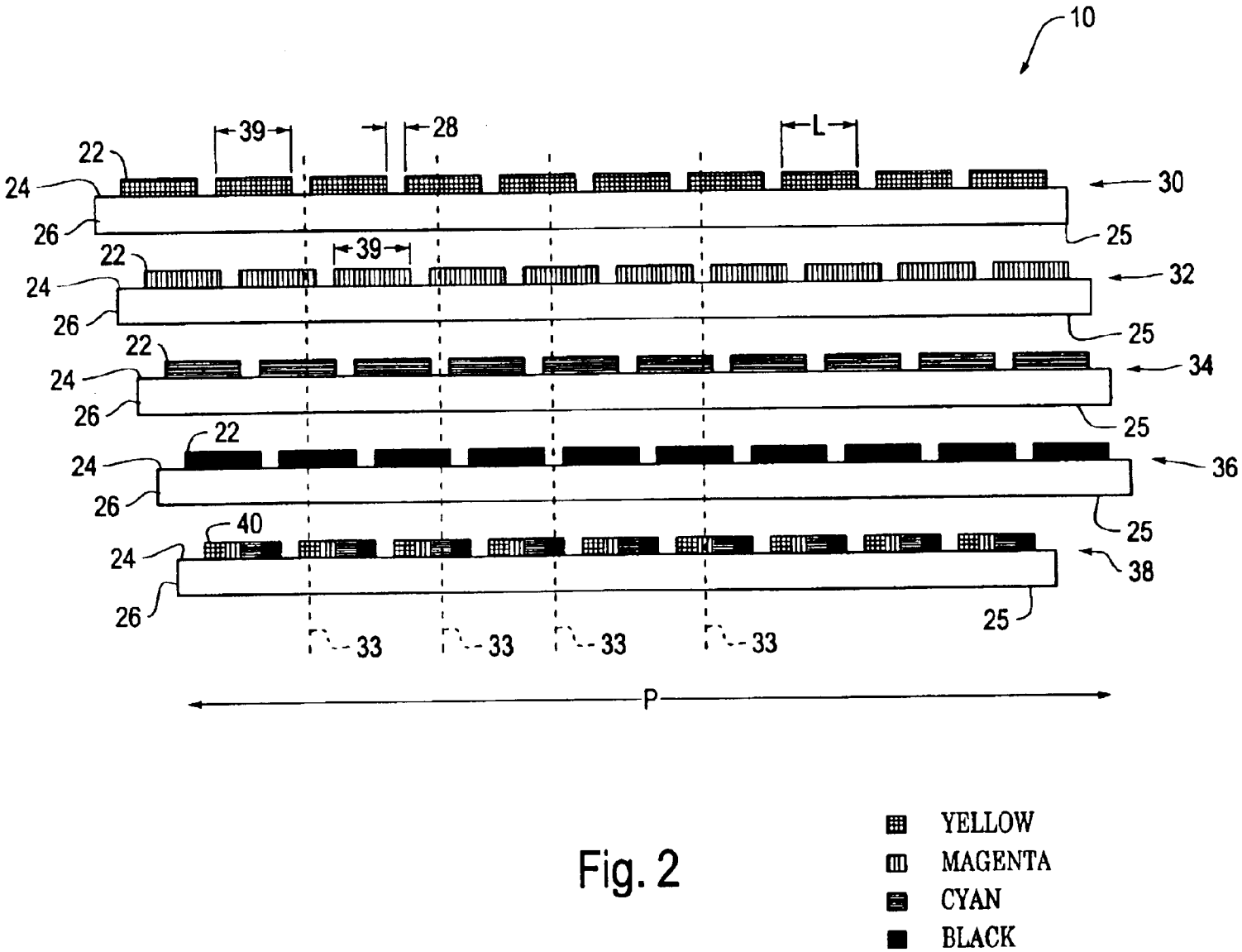
FIG. 2 illustrates a five printbar configuration for a four-color nonbuttable full-width array printer.

There is also a single secondary printbar 38 containing multicolor die modules 40. Each multicolor die module consists of die module segments for each color joined together to form one multicolor die module. For example, as shown in FIG. 2, each multicolor die module 40 consists of a yellow die module segment, a magenta die module segment, a cyan die module segment and a black die module segment joined together to form each of the multicolor die modules 40.

The multicolor die modules 40 on the secondary printbar 38 bridge the gaps 28 between the die modules 22 of the primary printbars 30, 32, 34 and 36. The primary printbars 30, 32, 34 and 36 are offset from one another in order to align the respective gaps 28 between die modules in each printbar with the die module segments of that color on the secondary printbar 38. This alignment is preferably vertical, i.e., the alignment is substantially parallel with a line running perpendicularly from a top edge to a bottom edge of a print medium.

Since the multicolor die modules 40 of the secondary printbar 38 fill the gaps 28 between die modules 22 of the primary printbars 30, 32, 34 and 36, if there are number N of die modules 22 of each of the primary printbars 30, 32, 34 and 36, there can be N−1 multicolor die modules 40 that make up the secondary printbar 38.

DETAILED DESCRIPTION OF PREFERRED EMBODIMENTS

As used herein, the term "printbar" is used to refer to a single row of a plurality of substantially aligned die modules. The row of die modules is preferably substantially aligned with respect to a line parallel with a top edge of a print medium to be printed upon, i.e., aligned across the width of the print medium. Each of the substantially aligned die modules of a printbar are typically mounted upon a substrate. The substrate for a single printbar may either be continuous or discontinuous. Further, die modules of different printbars may share a common substrate, for example where a substrate has one or more die modules of one printbar on one side thereof and one or more die modules of a different printbar on an opposite side. For ease in illustration and understanding, the Figures show each printbar mounted on a separate continuous substrate.

Figure 1:
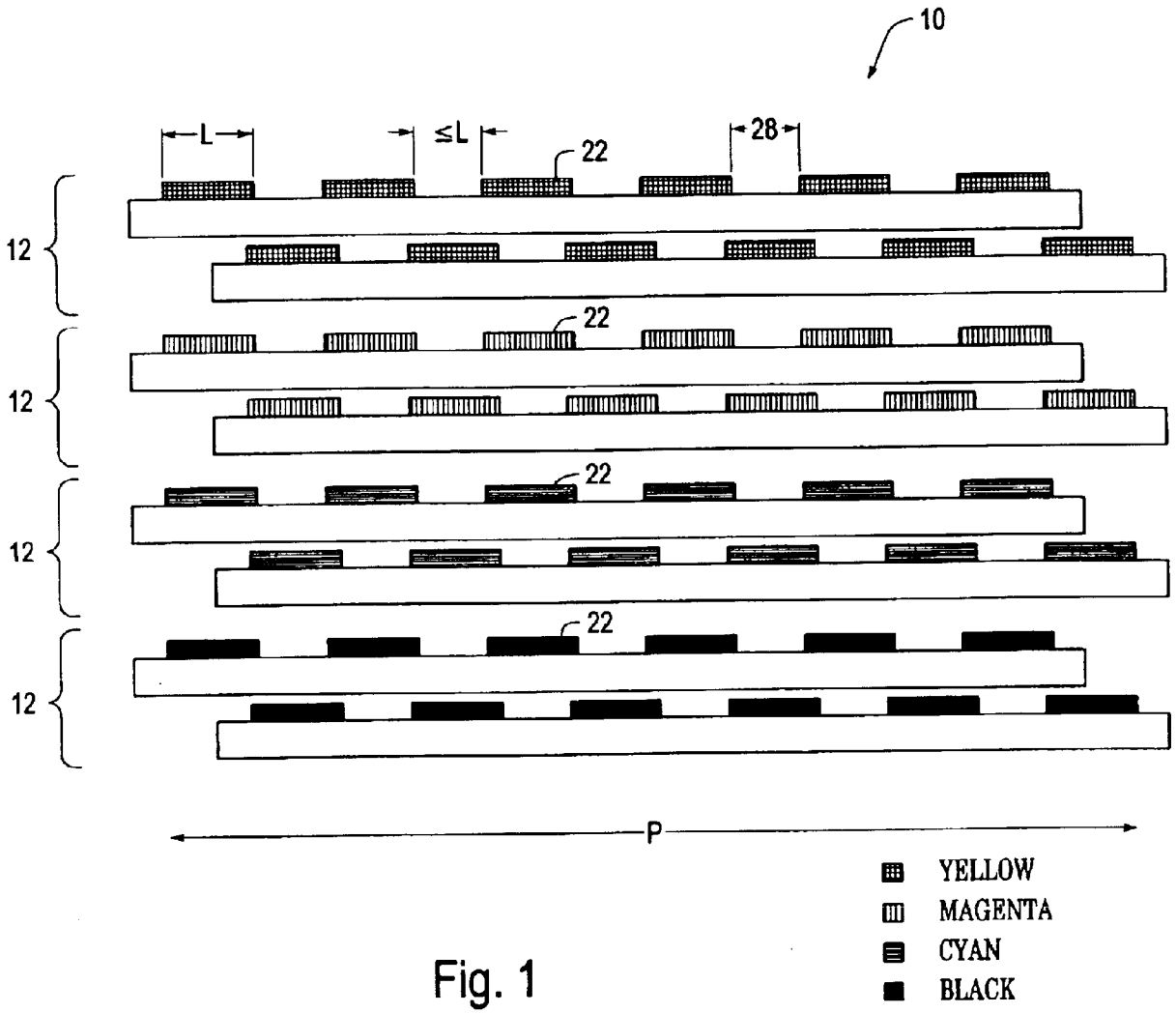
FIG. 1 illustrates an eight printbar configuration in a four-color nonbuttable full-width array printer.

FIG. 1 shows a typical printhead configuration 10 for a four-color nonbuttable full-width array printer. There are two halfbars 12 for each of the four colors, cyan (C), magenta (M), yellow (Y) and black (B) for a total of eight halfbars 12. There are six die modules 22 for each of the halfbars 12, or twelve die modules 22 for each color. The total allowable printing length P is printed using the two complementary staggered halfbars 12 for each color.

Although two complementary printbars for each of the four colors, or eight printbars in total, is commonly used, an additional set of two printbars for each of possible additional colors, such as, for example, light cyan or light magenta, may be added. Thus, the total number of printbars may be greater than eight, for example, twelve, or the like. In the configuration of FIG. 1, the total number of printbars required is always twice the number of colors to be printed.

An advantage of the configuration of the present invention is that the total number of printbars employed is less than twice the number of colors to be printed. Specifically, where X represents the total number of colors that can be applied by the printhead, the total number of printbars Y of the printhead in the present invention satisfies the relationship $X<Y<2X$.

In addition, the printhead also has at least one ink supply line for each of the X number of different colors that supply a colored ink to the die modules that print that colored ink.

For example, the primary printbar for yellow 30 has 10 yellow colored die modules 18 spaced substantially evenly apart. The secondary printbar 38 has nine multicolor die modules 40 including the color yellow Y. The multicolor die modules 40 are lined up such that the color yellow Y die module segment of the multicolor die modules 40 covers the gap 28 left exposed by the single color yellow die modules of the primary printbar for yellow 30. Thus, the yellow Y of the multicolor die modules covers the gap 28 left between the substantially evenly spaced die modules of the primary printbar for yellow 30. By "covers the gap" and similar terminology herein it is meant that the vertical alignment of the die modules is such that the die modules, if superimposed onto a single horizontal line, would at least substantially cover the line.

Although it is not specifically shown in FIG. 2, the die modules 22 of the primary printbars 30, 32, 34 and 36 can be slightly closer to each other than one quarter of the length L, so that there can be some printing overlap at the stitches between die of the primary printbars 30, 32, 34 and 36 and the adjacent segment of the same color of the secondary printbar 38.

More specifically, the printing regions 39 of the die modules 22 of each of the primary printbars 30, 32, 34 and 36 are separated by approximately a length of L/4 where L is a length of the die module printing zone. The separation between each of the four-color die modules 40 of the secondary printbar 38 is also approximately L/4. The primary printbars 30, 32, 34 and 36 are offset from one another by approximately L/4 so that the gaps 28 between printing zones of the primary printbars 30, 32, 34 and 36 line up with the appropriate color segments of the secondary printbar 38. This alignment is shown in FIG. 2, for example, by dashed lines 33 for yellow, cyan, black and magenta.

As discussed above, since the multicolor die modules 40 of the secondary printbar 38 fill the gaps 28 between die modules 22 of the primary printbars 30, 32, 34 and 36, if there are a total of N die modules for each of the primary printbars 30, 32, 34 and 36, there can be N−1 multicolor die modules 40 for the secondary printbar 38.

A print zone P for the entire printer is the region where all four colors can be printed. As shown in FIG. 2, the print zone P extends from the left edge of the leftmost die module 22 for the primary printbar for black 36 to the right edge of the rightmost die module 22 for the primary printbar for yellow 30. Other arrangements are possible in which different colors are used as the outermost die modules. Portions of each of the primary printbars 30, 32, 34 and 36 may extend beyond the print zone P.

Only a total of five printbars 30, 32, 34, 36 and 38 are needed in the embodiment illustrated in FIG. 2, compared to the eight halfbars 12 required in the configuration illustrated in FIG. 1. Accordingly, the present invention requires fewer printbars and enables a more compact printbar configuration.

In other words, in an embodiment of the present invention, the nonbuttable printhead of the present invention that can print a total of X colors (where X is greater than or equal to two), has Y printbars (where Y is an integer that is greater than X but less than 2X).

Figure 3:
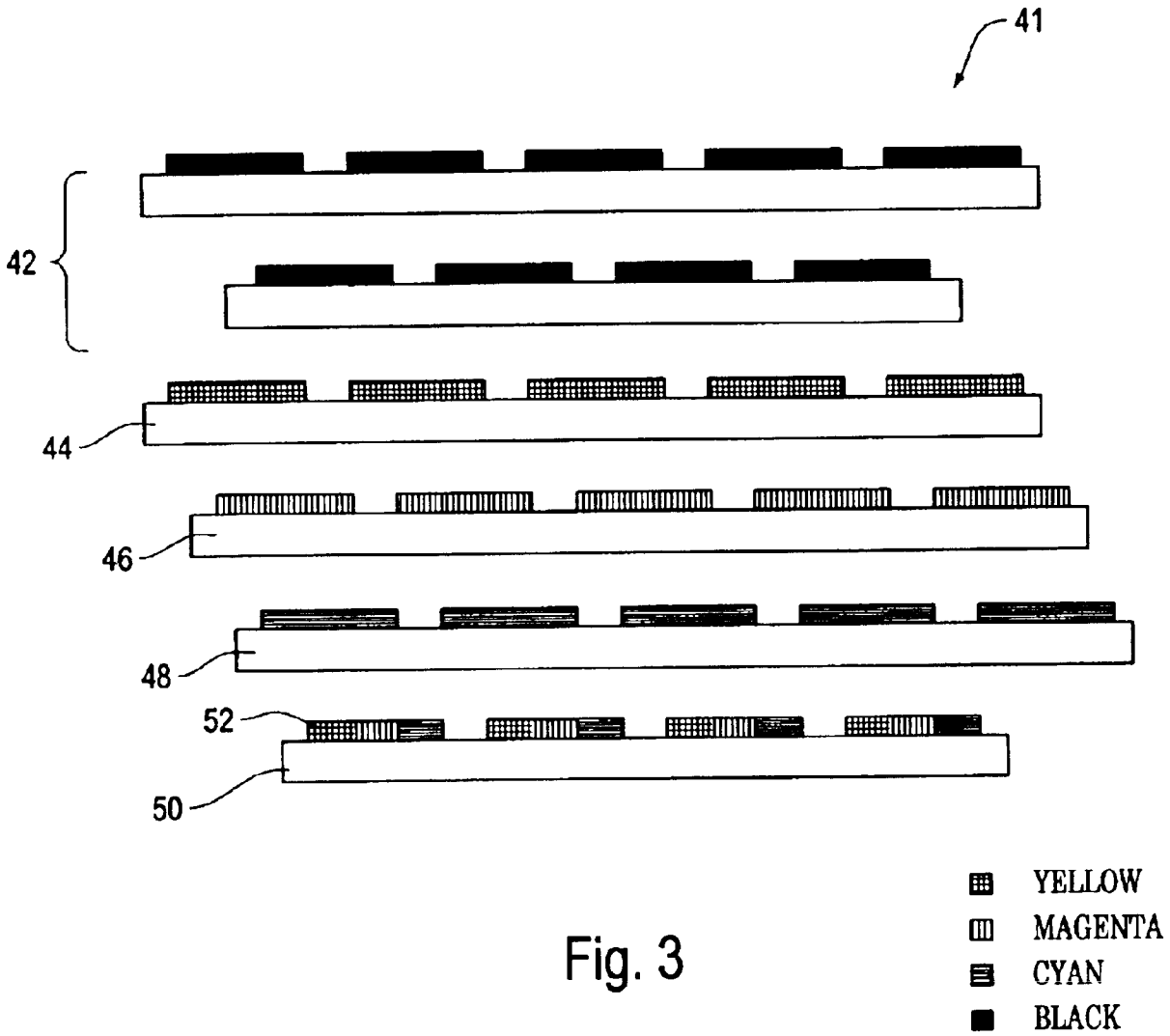
FIG. 3 illustrates a six printbar configuration for a four-color nonbuttable full-width array printer.

Further, because of printhead maintenance and drop ejector design issues, it may be advantageous to keep the die modules 22 of the primary printbar for black 36 completely separate from the other primary printbars 30, 32, and 34. Thus, as shown in FIG. 3, a printbar configuration 41 is illustrated with two halfbars 42 for black (K), single primary printbars for each of the colors cyan (C), magenta (M), and yellow (Y), and one secondary printbar 50 containing multicolor die modules 52 (in this case, three colors). In this embodiment, there are a total of six printbars for the four-color printer.

Any number of variations between the number and configuration of primary printbars, halfbars, and multicolor printbars may be used to reduce the total number of printbars required, i.e., to have the total number of printbars be less than twice the number of colors to be printed. Thus, the scope of the present invention is not limited by the embodiments illustrated herein.

Further, although the secondary printbars (38 in FIG. 2 and 50 in FIG. 3) have been described as being composed of multicolor die modules, it is also possible to use smaller independent die modules. For example, individual spaced apart cyan, magenta, yellow, and/or black die modules, which are preferably still each approximately L/4 in length, may be used to populate the secondary printbar, so long as the alignment of the spacing between die modules of the primary printbars is appropriately adjusted. Alternatively, a three-color cyan, magenta, yellow (CMY) multicolor die module, which is preferably approximately 3L/4 in length, may be used together with a separate, spaced apart black die module which is preferably approximately L/4 in length, so long as the alignment of the spacing between die modules of the primary printbars is appropriately adjusted.

Still further, in order to have a wider color gamut and/or smoother printing tones for photographic printing, some printers use more than four colors. For example, a printer may use a printhead including a "light cyan" printbar and a "light magenta" printbar in addition to the standard yellow (Y), cyan (C), magenta (M) and black (K) printbars. A typical printer including these six colors would require twelve halfbars for the six colors. The present invention could, for example, reduce the required number of printbars for a standard six color printer from twelve printbars to as low as 7 printbars (6 primary printbars and one secondary printbar).

A further application of the present invention enables a compact configuration even where there are redundant jets for each pixel for improved print quality by, for example, printing the same pixel location using two jets. Thus, with the present invention, rather than requiring four halfbars per color (sixteen printbars in a four-color printer), as few as two primary printbars per color plus two secondary printbars (ten printbars for a four-color printer) may be used. In other words, a second set of printbars, reduced in number in a similar manner as a first set of printbars as discussed extensively above, may be provided in order to reduce the total number of printbars in this redundant pixel printing embodiment. Even requiring only one secondary printbar in this application would be possible if the primary printbars are staggered from each other.

Yet a further application of the present invention allows for multiple pixel sizes from different printbars. In a modification to the embodiment described in the previous paragraph, the redundant printbars have substantially different drop sizes. Again, the total number of printbars required may be reduced.

With respect to the ink supply for the multicolor secondary printbar, an independent ink supply line for each section of each of the multicolor die modules may be provided. Optionally, the ink supply lines for the various colors may then be tied together, so that there is a single cyan, a single magenta, a single yellow and a single black ink supply line going to the secondary printbar. Alternatively, it is possible, for example, to have all of the die modules bonded directly to their respective printbars. It is also possible to align individual small printheads to compose each of the printbars.

These embodiments of the present invention are applicable to any ink jet printer having printbars composed of arrays of nonbuttable die modules where there is a space between printing regions of the adjacent die modules.

In another embodiment of the present invention, the configuration of the printbars is varied to improve the resulting print quality. The print quality is improved and the ink delivery system is simplified by preserving the order in which ink is deposited across the page. More specifically, the printbars are configured such that printbars with multicolor die modules are staggered between printbars with single color die modules.

Figure 4:
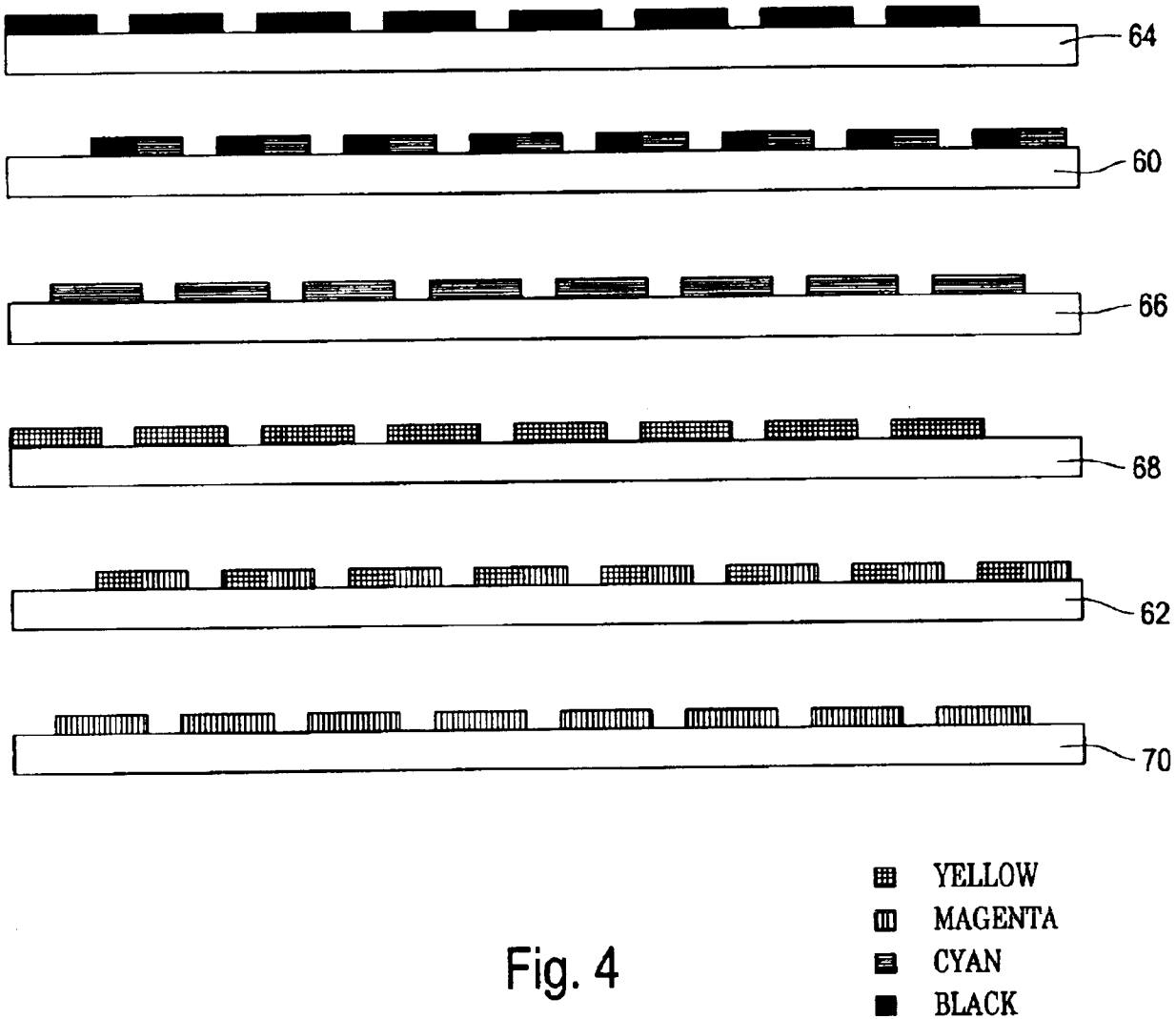
FIG. 4 illustrates a six printbar configuration for a four-color nonbuttable full-width array printer that preserves the order in which different colored ink is deposited across a print medium.

Printbars with multicolor die modules staggered between printbars with single color die modules are shown in FIG. 4. In this embodiment, as paper moves past the set of printbars, the color order will be the same across the page. More specifically, as shown in FIG. 4, first the color black is printed, then cyan, then yellow and then magenta. Although FIG. 4 illustrates a particular order of colors, any order of the colors is within the scope of the present invention.

For example, the yellow and magenta die modules may both be used to print a color red. Referring to FIG. 2, yellow would print before magenta for regions corresponding to where the single-color yellow die modules are directly in line with portions of the single-color magenta die modules. However, in regions corresponding to the gap between single-color yellow die modules, magenta would be printed first (from the single-color magenta die module) before yellow is printed from the multicolor die module of the secondary printbar. Printing yellow first followed by printing magenta may yield a different color, different intensity, different tone, or the like than printing magenta first followed by printing yellow. Thus, colors throughout the printed image may not be uniform and may appear to be distorted. It is acceptable for some print applications to have slight color distortion. In such cases, the color distortion is not readily apparent to the naked eye. However, in higher print quality applications, a better color print quality may be desired.

Referring to FIG. 4, colors are printed in one order only to avoid any possible color distortion and provide for color uniformity. In addition, the ink delivery system is simplified in that half as many ink lines are required to be run to each of the two-color multicolor printbars 60 and 62, compared to that of the four-color multicolor printbar 38 shown in FIG. 2. Moreover, the two-color printbars 60 and 62 are located midway between printbars 64 and 66, and 68 and 70, respectively. Each of the printbars 64, 66, 68 and 70 contain single-color die modules of the same colors as that in each of the two-color printbars 60 and 62. Specifically, the two-color multicolor printbar 60 has black and cyan die modules and is located midway between printbar 64 having black die modules and printbar 66 having cyan die modules. The two-color multicolor printbar 62 has yellow and magenta die modules and is located midway between printbar 68 having yellow die modules and printbar 70 having magenta die modules.

A total of six printbars are required in the embodiment illustrated in FIG. 4, compared to the five printbars illustrated in FIG. 2. However, the embodiment in FIG. 4 still provides a more compact print zone than the eight nonbuttable printbars used in the configuration, as illustrated in FIG. 1. Further, the configuration of FIG. 4 also allows for better color uniformity than the embodiment illustrated in FIG. 2, as discussed above.

The embodiments are not limited to only printbars including four colors as shown in the drawings. Using a printbar having two-color die modules sandwiched between printbars having respective single-color die modules can be used with any number of colors. For example, this embodiment may also be extended to a full-width array system with six ink colors, such as, for example, cyan, dilute cyan, magenta, dilute magenta, yellow and black. With a six color printer, the standard full-width array construction using printbars having nonbuttable die modules would require twelve printbars. With the embodiment illustrated in FIG. 4, only nine printbars would be required (one printbar for each of the six single-color die modules, plus three two-color printbars). The total number of printbars may be further reduced by the embodiment illustrated in FIG. 2 to seven printbars (one printbar for each of the six single-color die modules, plus one multicolor printbar). It is conceivable that the printbars of any standard color printer may be reduced as described above.

Further, to produce a better range of colors, the volume of ink dispersed may vary between the die modules. It is envisioned that the embodiments of the present invention may include any number of variations in printbars, such as, for example, printers with die modules of varying colors, printbars that disperse die in volumes of varying amounts to effect a better range in colors, and the like.

Further, the described embodiments may be used with any number of printers including thermal ink jet printers and the like. The described embodiments may be used with copiers, facsimile machines, or any equipment in which multiple colors are being printed.

Those skilled in the art will recognize that certain variations and/or additions can be made in these illustrative embodiments. It is apparent that various alternatives and modifications to the embodiments can be made thereto. It is, therefore, the intention in the appended claims to cover all such modifications and alternatives as may fall within the true scope of the invention.

What is claimed is:

1. A printhead for a color printer comprising:

a first color printbar comprised of a plurality of first color die modules spaced substantially evenly apart and having a gap between each of the plurality of first color die modules;

a second color printbar for printing a second color different from the first color and comprised of a plurality of second color die modules spaced substantially evenly apart and having a gap between each of the plurality of second color die modules;

a third printbar comprised of a plurality of multicolor die modules, each of the plurality of multicolor die modules comprising a single die module segment of the first color and a single die module segment of the second color; and a print region covered by the combination of the plurality of first color die modules, the plurality of second color die modules and the plurality of multicolor die modules, wherein each of the plurality of multicolor die modules substantially covers the print region exposed by the gaps between each of the plurality of first color die modules and between each of the plurality of second color die modules.

2. The printhead of claim 1 further comprising:

a fourth color printbar comprised of a plurality of third color die modules spaced substantially evenly apart and having a gap between each of the plurality of third color die modules; and a fifth color printbar comprising a plurality of fourth color die modules spaced substantially evenly apart and having a gap between each of the plurality of fourth color die modules, wherein each of the plurality of multicolor die modules of the third printbar further comprise a single die module segment of the third color and a single die module segment of the fourth color;

wherein the print region is covered by the combination of the plurality of first color die modules, the plurality of second color die modules, the plurality of third color die modules, the plurality of fourth color die modules and the plurality of multicolor die modules, wherein each of the plurality of multicolor die modules substantially covers the print region exposed by the gaps between each of the plurality of first color die modules, the plurality of second color die modules, the plurality of fourth color die modules and the plurality of fifth color die modules.

3. The printhead of claim 1 wherein the color printbars are in substantially vertical alignment, the second color printbar located between the first color printbar and the third color printbar.

4. The printhead of claim 1 wherein the color printbars are in substantially vertical alignment and the third color printbar, comprised of the plurality of multicolor die modules, is located between the first color printbar and the second color printbar.

5. The printhead of claim 1 further comprising:

a fourth color printbar and a fifth color printbar each having a plurality of third color die modules spaced substantially evenly apart and having a gap between each of the plurality of third color die modules, wherein the plurality of third color die modules are staggered such that the plurality of third color die modules of the fourth color printbar substantially cover the print region exposed by the gaps on the fifth color printbar and the plurality of third color die modules of the fifth color printbar substantially cover the print region exposed by the gaps on the fourth color printbar.

6. The printhead of claim 5 wherein the color printbars are substantially in vertical alignment, the first color printbar and the second color printbar located between after the fourth color printbar and the fifth color printbar and before the third color printbar.

7. The printhead of claim 1 wherein each of the plurality of first color die modules of the first color printbar are mounted on a top side of a substrate and each of the plurality of second color die modules of the second printbar are mounted on an opposite side of the substrate.

8. The printhead of claim 1 wherein the plurality of first color die modules of the first color printbar are mounted on a top surface of a first substrate, the plurality of second color die modules of the second printbar are mounted on a top surface of a second substrate and the plurality of multicolor die modules of the third printbar are mounted on a top surface of a third substrate.

9. A method for reducing the number of nonbuttable full-width array printbars in a printer, the method comprising the steps of:

providing a first color printbar having a plurality of first die modules each having a same first color, wherein each of the plurality of first die modules are spaced apart on the first color printbar;

providing a second color printbar having a plurality of second die modules each having a same second color, wherein each of the plurality of second die modules are spaced apart on the second color printbar;

providing a third color printbar having multicolor die modules each comprising the first color and the second color; and locating the plurality of multicolor die modules of the third color printbar such that the plurality of multicolor die modules substantially cover a print region not covered by the spaced apart plurality of first die modules on the first color printbar and spaced apart plurality of die modules on the second color printbar.

10. The method of claim 9 wherein the color printbars are in substantially vertical alignment, the second color printbar located between the first color printbar and the third color printbar and further wherein ink in each of the plurality of first die modules, the plurality of second die modules and the plurality of multicolor die modules is printed from each of the first color printbar, second color printbar and third color printbar, in sequential order.

11. The method of claim 9 further comprising the steps of:

locating the third color printbar, comprised of the plurality of multicolor die modules, between the first color printbar and the second color printbar in substantially vertical alignment; and printing color from the first color printbar, printing color from the third color printbar and then printing color from the second color printbar, in that order.

12. The method of claim 9 further comprising the steps of:

providing a fourth color printbar having a plurality of third die modules each having a same third color, wherein each of the plurality of third die modules are spaced apart on the fourth color printbar;

providing a fifth color printbar having a plurality of fourth die modules each having a same fourth color, wherein each of the plurality of fourth die modules are spaced apart on the fifth color printbar;

wherein the multicolor die modules of the third color printbar each comprise the first color, the second color, the third color and the fourth color, wherein each of the plurality of multicolor die modules on the third color printbar are located such that the plurality of multicolor die modules cover a print region not covered by the spaced apart plurality of first die modules on the first color printbar, spaced apart plurality of second die modules on the second color printbar, spaced apart plurality of third die modules on the fourth color printbar and the spaced apart plurality of fourth die modules on the fifth color printbar.

13. The method of claim 12 further comprising the steps of:

providing a sixth color printbar having a plurality of fifth color die modules each having a same fifth color, wherein each of the plurality of fifth die modules are spaced apart on the sixth color printbar;

providing a seventh color printbar having a plurality of sixth die modules each having a same sixth color, wherein each of the plurality of sixth die modules are spaced apart on the seventh color printbar;

wherein the multicolor die modules of the third color printbar each comprise the first color, the second color, the third color, the fourth color, the fifth color and the sixth color; and wherein each of the plurality of multicolor die modules on the third color printbar are located such that the plurality of multicolor die modules cover a print region not covered by the spaced apart plurality of first die modules on the first color printbar, the spaced apart plurality of second die modules on the second color printbar, the spaced apart plurality of third die modules on the fourth color printbar, the spaced apart plurality of fourth die modules on the fifth color printbar, the spaced apart plurality of fifth die modules on the sixth color printbar and the spaced apart plurality of sixth die modules on the seventh color printbar.

14. A nonbuttable printhead comprising a set of printbars, each printbar comprised of a row of a plurality of nonbuttable die modules in substantial alignment, the set of printbars including a total number of printbars (Y) satisfying the relationship $$X<Y<2X$$

wherein X represents a total number of different colors capable of being applied by the printhead, and wherein at least one printbar of the set of printbars has a plurality of multicolor die modules.

15. The printhead of claim 14 wherein the total number of printbars is five for a printhead that applies four different colors, the set of printbars comprising one primary printbar for each of the four different colors and one secondary printbar comprising die modules for each of the four different colors.

16. The printhead of claim 14 wherein the total number of printbars is six for a printhead that applies four different colors, one of which is black, the set of printbars comprising two printbars for black, one primary printbar for each of the three remaining different colors, and one secondary printbar comprising die modules for each of the three remaining different colors.

17. The printhead of claim 14 wherein the total number of printbars is six for a printhead that applies four different colors, the set of printbars comprising, in order, a first primary printbar for a first color, a first secondary printbar comprising die modules for the first color and a second color, a second primary printbar for the second color, a third primary printbar for a third color, a second secondary printbar comprising die modules for the third color and a fourth color, and a fourth primary printbar for the fourth color.

18. The nonbuttable printhead of claim 14 wherein the die modules of each of the printbars of the set of printbars are each mounted upon a surface of a substrate.

19. The nonbuttable printhead of claim 14 further comprising:

a second set a set of printbars wherein each printbar is comprised of a row of a plurality of nonbuttable die modules in substantial alignment, the second set of printbars including a total number of printbars (Y) satisfying the relationship $$X<Y<2X$$

wherein X is as defined above.

20. The nonbuttable printhead of claim 19 wherein the first set of printbars have a drop size and the second set of printbars have a drop size substantially different from the drop size of the first set of printbars.

* * * * *